US005333872A

United States Patent [19]

Manning et al.

[11] Patent Number: 5,333,872

[45] Date of Patent: Aug. 2, 1994

[54] GOLF CLUB IRONS HAVING IMPROVED WEIGHTING

[75] Inventors: George E. Manning; Brian E. Fortini, both of Prospect, Ky.; Vincent R. Reymann, Jr., Hendersonville, Tenn.

[73] Assignee: Hillerich & Bradsby Co., Inc., Jeffersonville, Ind.

[21] Appl. No.: 6,328

[22] Filed: Jan. 21, 1993

[51] Int. Cl.[5] ..... A63B 53/04

[52] U.S. Cl. ..... 273/169; 273/167 F; 273/167 H; 273/77 A; 273/164.1

[58] Field of Search ..... 273/167 R–77 A, 273/77 R, 164.1, 193 R, 194 R, 194 A, 162 R; D21/217, 218, 219

[56] References Cited

U.S. PATENT DOCUMENTS

| | | | |
|---|---|---|---|
| D. 321,919 | 11/1991 | Cheng . | |
| D. 323,689 | 2/1992 | Hardman et al. . | |
| 1,917,774 | 7/1933 | Ogg et al. . | |
| 2,846,228 | 8/1958 | Reach . | |
| 3,655,188 | 4/1972 | Solheim . | |
| 3,751,035 | 8/1973 | Lockwood | 273/167 F X |
| 3,995,857 | 12/1976 | Cochran et al. . | |
| 4,027,885 | 6/1977 | Rogers . | |
| 4,200,286 | 4/1980 | Bennett . | |
| 4,322,083 | 3/1982 | Imai . | |
| 4,420,156 | 12/1983 | Campau . | |
| 4,621,813 | 11/1986 | Solheim . | |
| 4,632,400 | 12/1986 | Boone . | |
| 4,715,601 | 12/1987 | Lamanna . | |
| 4,802,672 | 2/1989 | Long . | |
| 4,826,172 | 5/1989 | Antonious . | |
| 4,848,747 | 7/1989 | Fujimura et al. . | |
| 4,854,581 | 8/1989 | Long . | |
| 4,858,929 | 8/1989 | Long . | |
| 4,900,028 | 2/1990 | Antonious . | |
| 4,907,806 | 3/1990 | Antonious . | |
| 4,921,252 | 5/1990 | Antonious . | |
| 4,932,658 | 6/1990 | Antonious . | |
| 4,938,047 | 7/1990 | Antonious . | |
| 4,957,294 | 9/1990 | Long . | |
| 4,995,609 | 2/1991 | Parente et al. . | |
| 5,011,151 | 4/1991 | Antonious . | |
| 5,014,993 | 5/1991 | Antonious . | |
| 5,026,056 | 6/1991 | McNally et al. . | |
| 5,044,637 | 9/1991 | Wilson | 273/169 X |
| 5,046,733 | 9/1991 | Antonious . | |
| 5,048,834 | 9/1991 | Gorman . | |
| 5,048,835 | 9/1991 | Gorman . | |
| 5,074,563 | 12/1991 | Gorman . | |
| 5,078,397 | 1/1992 | Aizawa . | |
| 5,078,400 | 1/1992 | Desbiolles et al. . | |
| 5,110,131 | 5/1992 | Long | 273/77 A X |
| 5,120,062 | 6/1992 | Scheie et al. . | |
| 5,160,136 | 11/1992 | Eger | 273/77 A |
| 5,193,805 | 3/1993 | Solheim . | |
| 5,209,473 | 5/1993 | Fisher | 273/77 A |

FOREIGN PATENT DOCUMENTS

| | | | |
|---|---|---|---|
| 0517487 | 12/1992 | European Pat. Off. | 273/77 A |
| 2842245 | 4/1979 | Fed. Rep. of Germany | 273/169 |

OTHER PUBLICATIONS

"Golf Digest", Magazine, Dec. 1977 issue, p. 101, (copy in class 273, subclass 167F).

*Primary Examiner*—Vincent Millin
*Assistant Examiner*—Sebastiano Passaniti
*Attorney, Agent, or Firm*—Welsh & Katz, Ltd.

[57] ABSTRACT

Golf club irons of the perimeter weighted type are provided wherein each iron of a set includes a club head having a toe portion, a heel portion having a hosel, a ball-striking face having a plurality of parallel substantially horizontal grooves formed therein, and a generally convex back surface. A cavity is formed in the back surface of each club head and configured to selectively distribute the weight about the perimeter of the head no create a plurality of elliptical force lines concentric with the sweet spot on the club face and having their major axis substantially parallel to the grooves on the club face. Golf irons in accordance with the present invention effectively provide larger sweet spots on the hitting faces of the irons so as to produce results from off-center shots that more closely approach the results produced when balls are struck by the exact sweet spot on the club face.

20 Claims, 3 Drawing Sheets

GOLF CLUB IRONS HAVING IMPROVED WEIGHTING

BACKGROUND OF THE INVENTION

The present invention relates generally to golf clubs of the iron type, and more particularly to novel golf club irons of the perimeter weighted type which provide substantially improved distance, accuracy and consistency over prior golf irons.

Recent advances in golf club iron design have introduced the concept of peripheral or perimeter weighting the club head wherein a significant portion of the weight of the head is distributed in a predetermined pattern about the perimeter of the club head. The perimeter weighting extends generally peripherally of a cavity in the back of the club head, and also peripherally of the "sweet spot" on the ball-striking face of the club head. Ideally, the sweet spot, which is determined by the center of mass of the club head, alternatively termed the center of gravity, is located generally centrally on the ball-striking face of the club head. Conventionally, the ball-striking face is defined by a planar surface having a predetermined loft angle and a plurality of parallel spaced grooves or score lines formed therein which are disposed generally horizontally when the club head is in its normal ball addressing orientation. During play, striking a golf ball off-center from the sweet spot can adversely affect the distance, trajectory, direction and spin imparted to the ball, thus affecting the consistency of results between shots with a particular loft iron. Further, and a problem particularly encountered by golfers of lower skill level, the club head may rotate about an axis generally parallel to the axis of the club shaft at the moment of impact with a ball due either to under or over rotation of the golfer's hands, or due to off-center striking of the ball. Such rotation of the club head further reduces the accuracy, distance, trajectory and consistency desired, frequently resulting in slicing or hooking of the ball.

Perimeter weighted golf irons of the aforedescribed type, which may also be termed "cavity back" irons, are believed to provide a larger sweet spot area on the striking face of the iron, thereby allowing a ball to be struck at a point spaced or off-center from the exact point on the club face aligned with the center of mass of the iron, termed the exact sweet spot, with fewer adverse consequences than experienced with non-cavity irons. Known perimeter weighted golf irons generally create a plurality of substantially concentric elliptical force lines about the exact sweet spot on the ball-striking face. A ball impacted on a given elliptical force line will have substantially the same impact energy imparted to the ball irrespective of the relationship of the point of impact to the exact sweet spot on face of the iron. For example, different points of impact on a given elliptical force line may be spaced from the sweet spot at different distances but will result in equal impact energy being imparted to the ball.

A significant drawback in known perimeter weighted irons is that the major axis of the concentric elliptical force lines is inclined to the parallel grooves in the ball-striking face of the iron, generally extending from high in the heel portion of the club to low on the toe portion. This is due to the disproportionate amount of mass associated with a club head neck or hosel in relation to the remainder of the club head. As a result, the effective off-center distance or spacing from the exact sweet spot on the club face that a ball may be impacted, and particularly in a horizontal off-center direction, without incurring the aforementioned adverse consequences is significantly reduced over a design where the major axis of the concentric elliptical force lines is parallel to the grooves in the club face.

Accordingly, perimeter weighted golf irons wherein the major axis of the concentric elliptical lines of force is substantially parallel to the grooves in the club face would provide significantly improved performance over known perimeter weighted irons by improving the distance, accuracy and consistency attained with iron shots.

SUMMARY OF THE INVENTION

A general object of the present invention is to provide novel perimeter weighted golf irons which provide improved distance, accuracy, trajectory and overall consistency over prior perimeter weighted irons.

A more particular object of the present invention is to provide perimeter weighted golf irons of the type which have a plurality of concentric elliptical force lines created about the exact sweet spot on the ball-striking face of the iron, and wherein the perimeter weighting is operative to orient the major axis of the concentric elliptical lines in parallel relation to horizontal grooves formed in the ball-striking face, thereby effectively increasing the sweet spot on the ball-striking face.

Another object of the present invention is to provide perimeter weighted golf irons wherein any rotation of the club head due to the reaction force of striking a ball off-center from the exact sweet spot on the face of the club head takes place about a substantially vertical axis of rotation, thereby leading to significantly improved consistency of shot trajectory.

Still another object of the present invention is to provide novel perimeter weighted golf irons wherein each iron has a cavity formed in the rear surface of the club head which is configured so that a predetermined mass of material remains in the high toe portion of the club head and orients the concentric elliptical force lines so that their major axis is parallel to the grooves in the face of the club head, whereby greater distance and accuracy, and more consistent trajectories can be achieved with balls struck off-center from the exact sweet spot on the club face.

In carrying out the present invention, golf club irons of the perimeter weighted type are provided wherein each iron of a set, from the long smaller loft angle irons to the short greater loft angle irons, includes a club head or body having a toe portion, a heel portion having a hosel, a ball-striking face extending from the toe portion to the heel portion and having a plurality of parallel substantially horizontal grooves formed therein, and a generally convex rear or back surface extending from an upper edge surface to a bottom sole surface. A cavity is formed in the rear surface which is configured so that the weight of the club head is selectively distributed about the perimeter of the head to create a plurality of elliptical force lines concentric with the sweet spot on the club face and having their major axis substantially parallel to the grooves on the club face. Such perimeter weighting is accomplished in the present invention without forming obtrusive and distracting projections outwardly from the surface of the club head when viewed from the normal address position prior to the golf swing. Golf irons in accordance with the present invention effectively provide larger sweet spots on the hitting faces of the irons than heretofore obtained, thereby producing results from off-center shots that more closely approach the results produced when balls are struck by the exact sweet spot on the club face.

Further objects, features and advantages of the present invention will become apparent from the following detailed description of the invention taken in conjunction with the accompanying drawings wherein like reference numerals designate like elements throughout the several views.

BRIEF DESCRIPTION OF THE DRAWINGS

FIGS. 8–10 are transverse sectional views taken substantially along lines 8—8, 9—9 and 10—10 of FIG. 7, respectively, but oriented so that the face surfaces lie in vertical planes.

DETAILED DESCRIPTION

Figure 1:
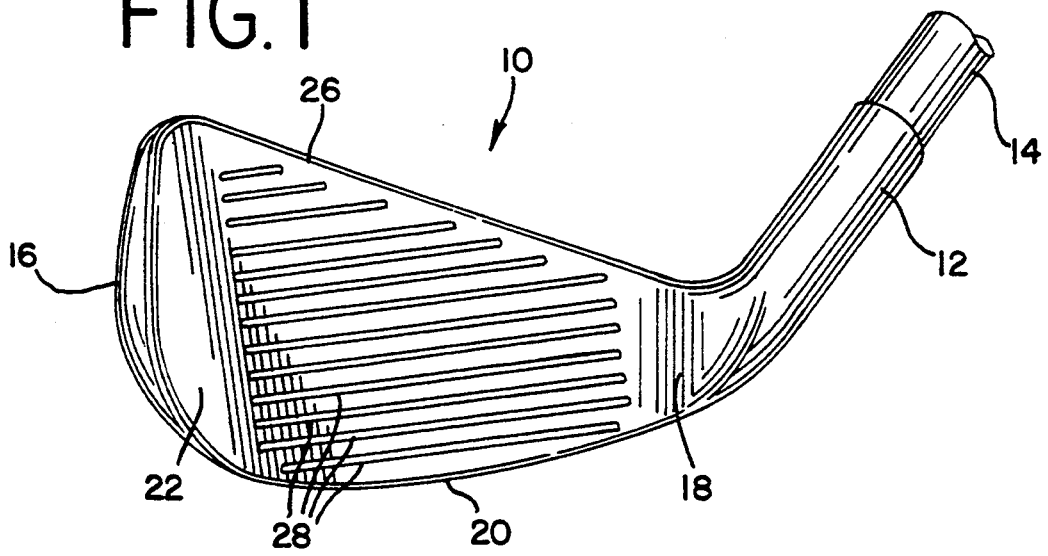
FIG. 1 is a fragmentary perspective view of a golf club iron constructed in accordance with the present invention.
Figure 2:
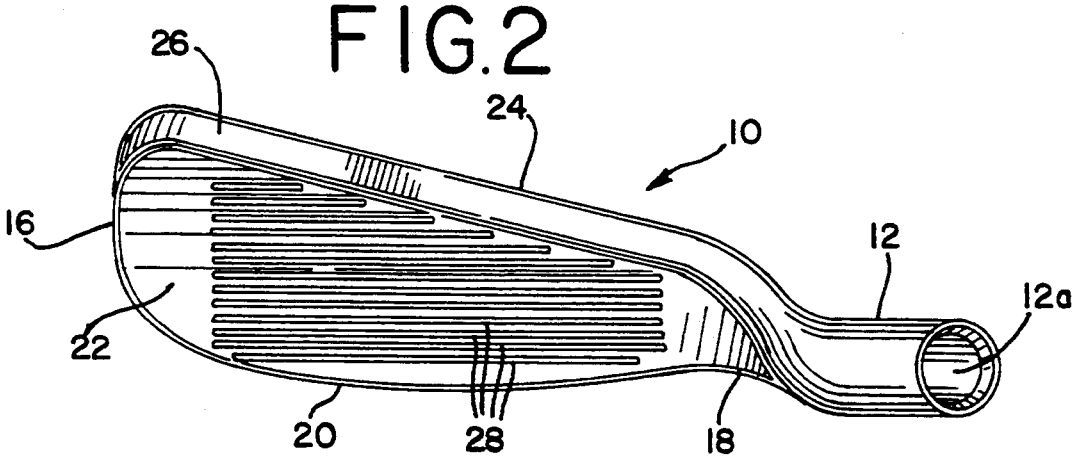
FIG. 2 is a plan view of the golf club iron of FIG. 1 but with the shaft removed from the hosel.
Figure 3:
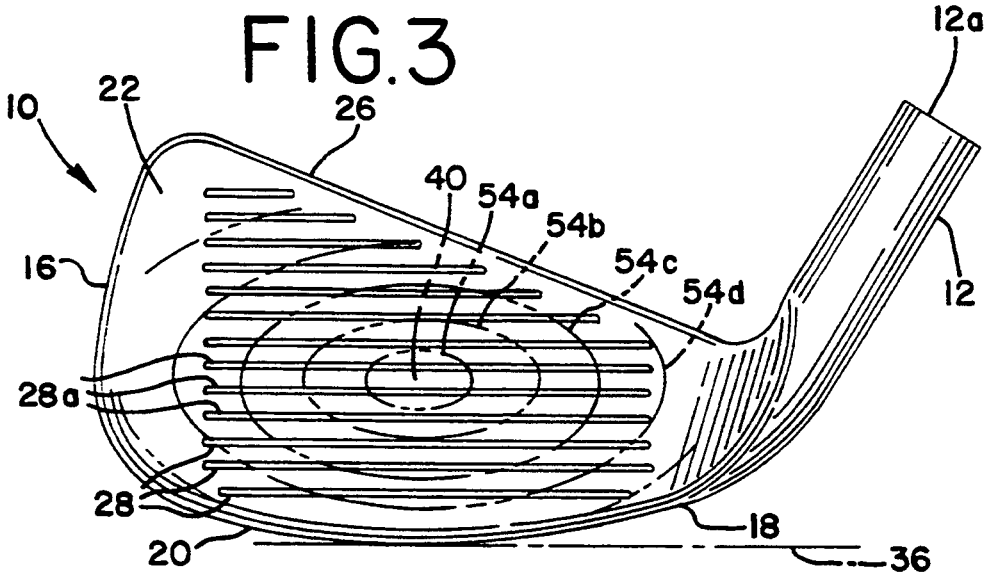
FIG. 3 is a front elevational view of the club head of FIG. 2 in a ball addressing orientation.
Figure 4:
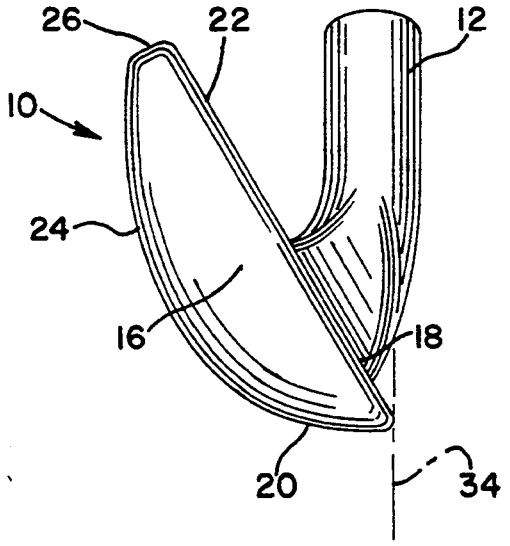
FIG. 4 is an end view of the club head of FIGS. 1–3 as viewed from the toe end.

Golf irons typically include a set of eleven irons, numbers one (long) through nine (short), a pitching wedge and a sand wedge. Referring to FIGS. 1–7, each iron comprises a head, indicated generally at 10, including a hosel 12 and a shaft, a portion of which is indicated at 14, which is attached to the head by fixing the shaft within an axial bore **12*a* of the hosel as by a suitable adhesive. An over-hosel connection of shaft 14 to hosel 12 could also be employed if desired. The hosel is attached to and generally formed integral with the head. The head is preferably made from a suitable metal, as by forging or casting, and includes a toe portion 16, a heel portion 18, a bottom sole 20, a planar ball-striking face 22 extending between the toe and heel portions, and a rear surface or backside 24. An upper edge or top line surface 26 is inclined upwardly relative to the sole from the heel 18 to the toe 16 and merges with the upper margin of the face 22 and with the upper margin of the rear surface or backside 24. A plurality of parallel grooves or score lines 28 are formed in the face 22 so as to lie in a horizontal orientation when the club head is in a ball addressing position as shown in FIGS. 2 and 3**.

The eleven irons of a set conventionally have varying degrees of loft angle, lie angle and face progression. The loft angle of an iron is the included angle between a vertical plane, such as represented by line 34 in FIG. 4 and which contains or is parallel to the longitudinal axis of the shaft and parallel to the grooves 28, and the plane of the ball-striking face of the iron. The loft angle determines how much loft is theoretically imparted to the ball when it is hit by the exact sweet spot on the face. The lie angle of an iron is the included acute angle between the axis of the shaft and a plane tangent to the bottom sole directly under the center of mass of the head, such as represented by line 36 in FIG. 3, and which is substantially horizontal when the shaft lies in a vertical plane with the club head in a normal ball addressing position. The lie angle of the iron assures that when swung properly, the grooves or score lines 28 in the club face 22 will be disposed substantially horizontal and the sole of the iron will contact the ground evenly so that the striking face will not tend to twist or rotate about an axis generally normal to the ground.

Face progression is the distance between a vertical plane parallel to the score lines in the face and containing the centerline of the hosel, and a vertical plane generally tangent to the lower leading edge of the face or blade of the club head when in a ball addressing orientation. The face progression assists in getting the player's hands ahead of the ball, facilitates higher flight and lessens the tendency to slice the ball.

Briefly, in accordance with the present invention, each iron of a set has a cavity formed in the rear surface or backside of the head. Each cavity is configured to create a predetermined weight distribution about the perimeter of the club head and establish a sweet spot, or optimum ball-striking spot, at substantially the center of the planar ball-striking face. For example, and referring to FIG. 3, the exact sweet spot for club head 10 is designated at 40 and is located mid-length of the longer length face grooves, indicated at **28*a*, and mid-height of the vertical height of the face 22 between the sole 20 and the upper edge 26** measured at the groove mid-length. The overall configuration of each club head of the set, and the configuration of its corresponding rear cavity, are such that the center of mass of the club head, alternatively termed the center of gravity, is aligned directly behind the corresponding sweet spot on the face of the club head. The rear cavity in each club head is also configured to establish a perimeter weight distribution such that a plurality of elliptical force lines are created in the ball-striking face concentric to the sweet spot, with the major axis of the concentric force lines being parallel to the grooves or score lines in the club face. As will be described in greater detail, these concentric elliptical force lines effectively increase the sweet spot on the ball-striking faces of the irons in a manner to significantly improve the distance, accuracy and consistency in shot trajectory even though a ball may be hit off-center from the exact sweet spot.

Figure 5:
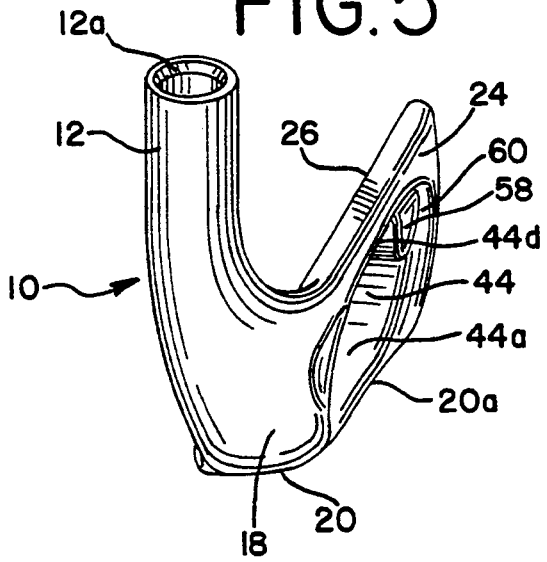
FIG. 5 is a perspective view of the club head of FIG. 3 viewed from the heel and hosel end of the head.
Figure 6:
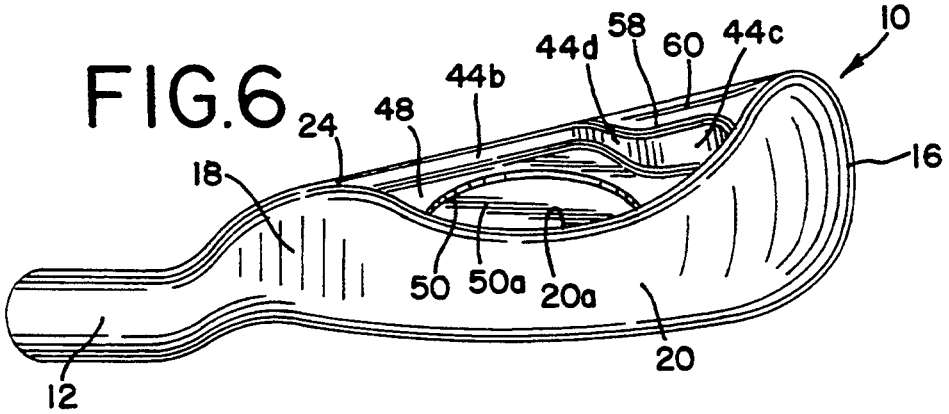
FIG. 6 is a bottom view of the club head of FIG. 3.
Figure 7:
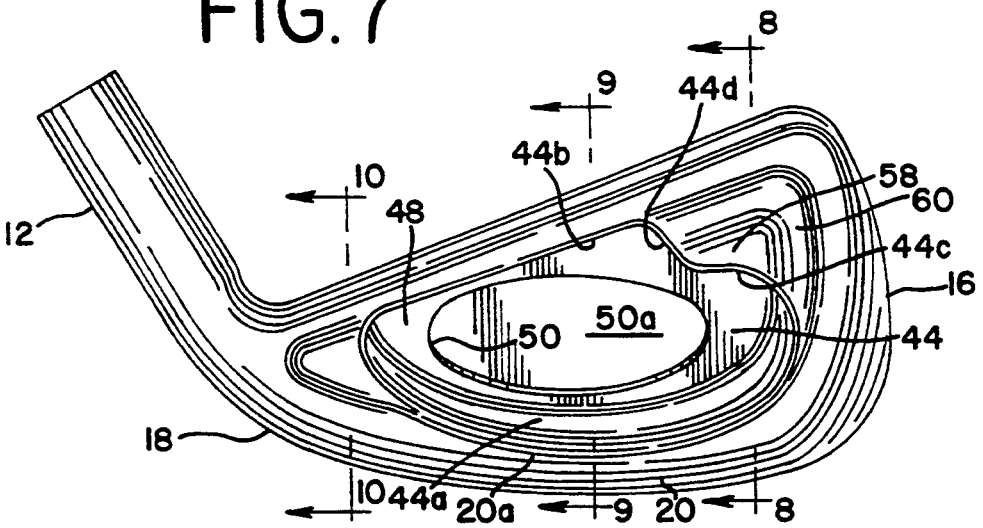
FIG. 7 is a rear elevational view of the club head of FIGS. 1–3.

Referring to FIG. 7, taken in conjunction with FIGS. 4–6 and 8–10, and with the illustrated club head 10 generally representative of the club heads of a set of golf irons in accordance with the present invention, the rear surface 24 has a convexly curved envelope from the upper edge surface 26 to the bottom sole 20. The upper edge surface 26 has equal transverse width through its length so that the upper marginal edge of the rear surface 24 is parallel to the upper marginal edge of the planar face 22. The sole 20 has progressively greater transverse width along its length from the heel to the toe, except for a central region to be described, and has a downwardly convex transverse cross-section of generally constant radius along its length. With the toe end of the ball-striking face 22 having greater height than the heel portion 18, considered in the place of the face, and with the rear surface of back 24 having a convex envelope, greater mass or weight is located in the toe of the club head to achieve the desired overall weight of the head and generally offset or counterbalance the combined weight of the heel portion 18 and hosel 12 while locating the center of mass of the head in rearward alignment with the centered sweet spot 40 on the face.

Figure 11:
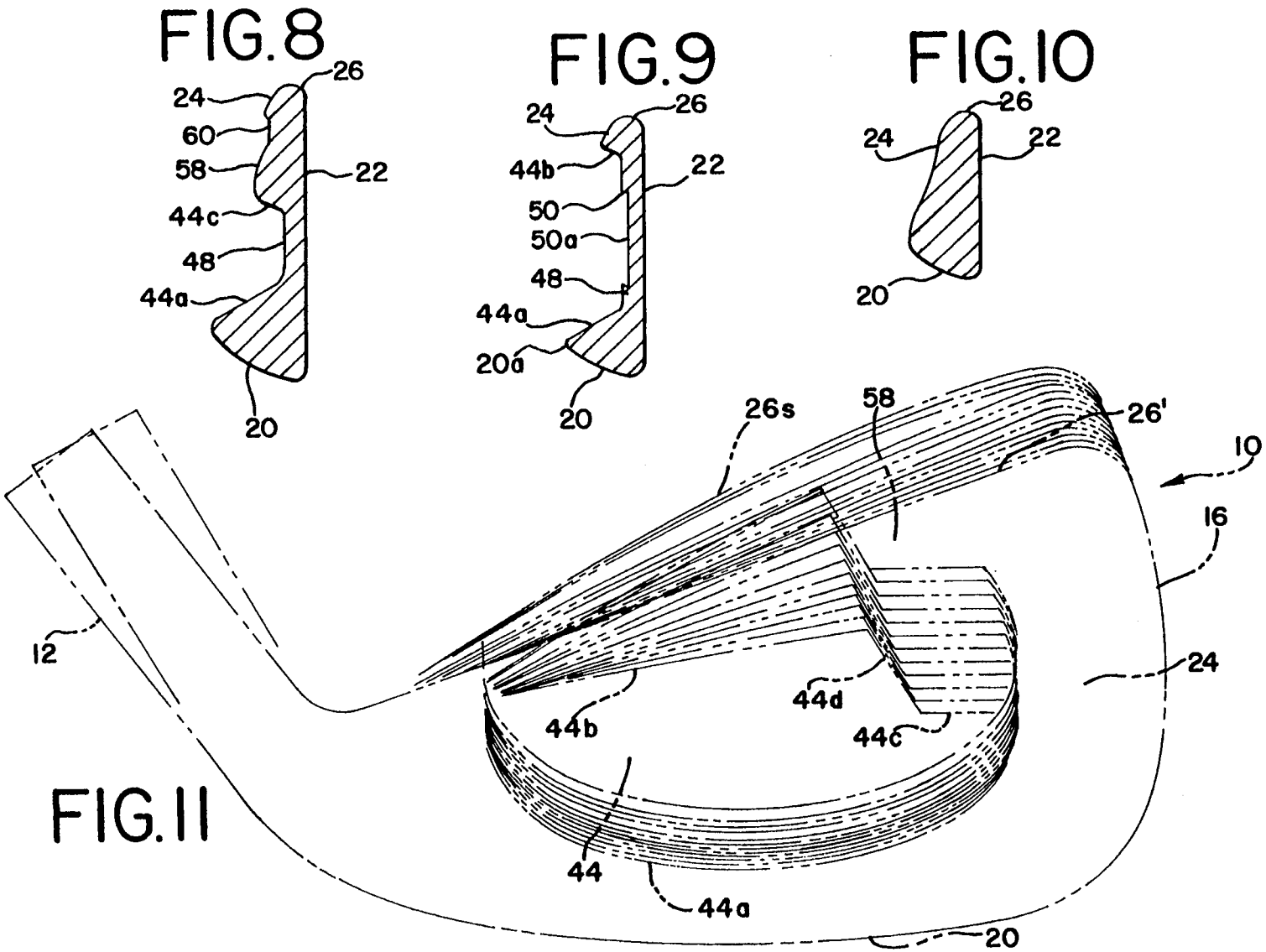
FIG. 11 presents an overlay of the outer perimeters of a set of irons, with the perimeters and relative locations of the corresponding back cavities being also shown in superimposed relation to illustrate the progression of increase in iron size and cavity size from the long irons to the short irons.

As illustrated in FIG. 7, a cavity 44 is formed in the rear surface or backside 24 of the head 10. The lower margin or boundary of cavity 44 is defined by a curved surface 44*a* having a curvature which generally takes the form of a lower approximately one-half of an ellipse whose major axis is parallel to the grooves 28 in the face 22. An upper boundary of cavity 44 is defined by a surface 44*b* which merges with the upwardly curved left-hand end of the lower boundary surface 44*a* and is inclined in an upward direction toward the toe area spaced from the upper edge surface 26. The boundary surface 44*b* is rectilinear for the cavities 44 in irons one through seven, and is curved to extend parallel to the curvature of the upper edge surface 26 on the eight iron through sand wedge. The upper right-hand corner of cavity 44, as viewed in FIG. 7, is defined in part by a generally uniformly curved surface 44*c* that merges with the right-hand end of the lower curved surface 44*a*. A generally rectilinear surface 44*d* extends between and merges with the boundary surfaces 44*c* and 44*b*. FIG. 11 depicts the outer peripheries of the club heads of a set of eleven irons in superimposed relation, with the corresponding rear cavities 44 in the various heads also being shown in superimposed relation to illustrate the progressive increase in cavity size as the head size increases from the longer irons to the short irons. For purposes of illustration, the top edge 26 of the number one iron is designated 26', and the top edge of the sand wedge is designated 26S. The cavities 44 both increase in size and are formed progressively higher from the sole 20 from the long irons to the short irons, including the pitching and sand wedges. While FIG. 11 illustrates the surfaces 44*c* and 44*d* as being relatively rectilinear and intersecting the respective surfaces 44*a* and 44*b* at sharp internal corners, the various surfaces 44*a–d* preferably intersect at rounded or radial fillet-like internal junctions as illustrated in FIG. 7.

The cavity 44 has a generally planar base surface area 48 which lies in a plane parallel to the front face 22. Because the sole 20 has significantly greater thickness than the upper edge surface 26, as considered transversely of the blade length between the heel and toe ends, the depth of cavity 44 at the lower boundary surface 44*a* is greater than the depth adjacent the upper boundary surface 44*b*. The lower cavity boundary surface 44*a* is angularly inclined in a downward direction relative to the plane of the base surface 48, as seen in FIGS. 8 and 9, so as to intersect the bottom sole surface 20 and reduce its transverse thickness along an intermediate portion of its length, as indicated at 20*a* in FIG. 6. This enables a greater portion of the weight of the club head to be selectively distributed about the perimeter of the head while maintaining the overall weight of each head at a weight necessary to obtain the desired swing weight for the finished iron.

Referring again to FIG. 7, an elliptical shaped recess 50 is preferably formed generally centrally within each cavity 44. The recess 50 has a relatively shallow depth, such as approximately 0.015", and has its major axis extending parallel to the grooves 28 in the club face 22 and preferably through a horizontal rearward projection of the exact sweet spot 40 on the face, considered with the club head in a normal ball-addressing orientation. The recess 50 has a planar base surface 50*a* which is parallel to the face 22 and establishes the minimum wall thickness between the face and the cavity 44, preferably not less than 0.130". The weight of material equivalent to the volume of recess 50 further contributes to the mass of material which can be selectively distributed about the perimeter of the head; that is, the mass of material theoretically removed from the cavity base surface 48 to create the elliptical recess 50 is available for perimeter weighting at other selective locations on the head.

In accordance with a feature of the invention, the cavity 44 in the backside of each iron of a set, including the corresponding elliptical recess area 50, is configured to establish a perimeter weight distribution about the head such that a plurality of elliptical force lines are created on the ball-striking face 22 of the club head concentric with the exact sweet spot 40, as depicted schematically in FIG. 3 by elliptical phantom lines 54*a–d*. Each of the elliptical force lines 54*a–d* may be considered as a line of points any one of which, when impacted by a ball at a moment of theoretical point contact, will cause substantially the same impact energy to be imparted to the ball. Thus, each ball which impacts the club head on the same elliptical force line will travel substantially the same distance, assuming the orientation of the club head and the swing speed at the moment of impact to be the same between shots. Each elliptical force line imparts an impact energy to a ball different from the other elliptical force lines, with each successive outward elliptical force line from the sweet spot imparting less impact energy to a ball. For example, a ball struck by a point on the elliptical force line 54*a* on a three iron may travel approximately 185 yards. A ball struck by a point on the elliptical force line 54*b* may travel approximately 180 yards, and a ball struck by a point on the elliptical force lines 54*c* or 54*d* may travel approximately 175 or 170 yards, respectively.

The size, configuration and orientation of each cavity 44 is such that the perimeter weighting of the corresponding club head orients the concentric elliptical lines of force within the ball-striking face so that the major axis of the elliptical lines lies substantially parallel to the grooves or score lines 28 and passes through the exact sweet spot. As illustrated in FIG. 3, by orienting the concentric elliptical lines of force so that their major axis lies parallel to the grooves 28, the effective size of the sweet spot is significantly increased in the area where the ball is hit most often, namely, along a generally rectangular relatively narrow band passing horizontally through the exact sweet spot 40. The elliptical force lines effectively extend the sweet spot area on both sides of the center 40 parallel to the face grooves or score lines 28. Stated alternatively, the different concentric elliptical force lines are spaced horizontally apart greater distances measured along their common major axis, thereby enabling a ball to be struck at a greater distance from the exact sweet spot without having the impact energy imparted to the ball significantly reduced, as compared to the case where the major axis of the elliptical force lines is angularly inclined to the grooves or score lines in the club face.

The specific configuration of the cavity 44 creates a weight mass 58 at the upper right-hand corner of the cavity in the high toe area of the club head. The weight mass 58 is bounded by the cavity boundary surfaces 44*c* and 44*d* and may be formed integral with the toe end of the club head. Preferably, a shallow recess or indentation 60 is formed in the back surface 24 about the outer perimeter of the weight mass 58 to give the cavity 44 a generally triangular appearance when viewed from the back of the climb head. The weight mass 58, together with the remaining mass or weight of the head about the perimeter of the head, effects the aforedescribed orientation of the elliptical force lines so that their major axis lies parallel to the score lines on the ball-striking face 22 and passes through the exact centered sweet spot. As illustrated in FIGS. 5 and 6, the weight mass 58 does not protrude outwardly of the convex boundary envelope of the rear surface or backside 24 of the club head. This is particularly advantageous when the club heads are viewed by the player from the normal address position prior to the golf swing because the club head does not have any obtrusive or distracting projections extending from the rear surface of the club head.

By way of example, the following table sets forth dimensional characteristics of a set of irons constructed in accordance with a preferred embodiment of the present invention. In addition to the table dimensions, the hosels of the various irons have a length of approximately 2¼", considered as the length of the hosel centerline from the outer end of the hosel to the intersection with the sole 20. Each iron has a blade length of approximately 3¼", considered from the toe to the intersection of the hosel centerline with the sole 20. In the illustrated embodiment, the score lines or grooves 28 are modified V-shaped grooves and have their outer ends spaced approximately 0.537" from the toe, as considered in FIG. 3. The longer score lines 28*a* are approximately 2⅜" in length. The bottom score line is preferably spaced approximately ¼" above the lowermost point of curvature of the sole 20. The radius of curvature of the toe 16, as considered in the plane of the ball-striking face 22, is approximately 3". The upper edge surface 26 is preferably substantially rectilinear for club heads one through seven, and is curved convexly upwardly at a top line radius of approximately 40" for the eight iron, 30" for the nine iron, 20" for the pitching wedge, and 10" for the sand wedge. The wall thickness between the elliptical recessed area 50 in the base surface 48 of each cavity 44 and the corresponding ball-striking face 22 is preferably maintained at a minimum thickness of 0.130".

| CLUB HEAD | 1 | 2 | 3 | 4 | 5 | 6 | 7 | 8 | 9 | P-48 | S-56 |
|---|---|---|---|---|---|---|---|---|---|---|---|
| LIE ANGLE | 55° | 56° | 57° | 58° | 59° | 60° | 61° | 62° | 63° | 63° | 63° |
| TOE HEIGHT MAX | 2 5/32" | 2 3/16" | 2 7/32" | 2¼" | 2 9/32" | 2 5/16" | 2 11/32" | 2⅜" | 2 13/32" | 2 7/16" | 2½" |
| LOFT ANGLE | 17° | 19° | 21° | 25° | 28° | 32° | 36° | 40° | 44° | 48° | 56° |
| FACE PROGRESSION | −.053" | −.053" | −.021" | .010" | .041" | .072" | .104" | .135" | .166" | .166" | .166" |
| SECT. 8 SOLE THICKNESS | 21/32" | 22/32" | 23/32" | 24/32" | 25/32" | 26/32" | 27/32" | 28/32" | 29/32" | 30/32" | 32/32" |
| SECT. 8 BLADE HEIGHT | 1.97" | 2.00" | 2.03" | 2.06" | 2.09" | 2.12" | 2.16" | 2.21" | 2.24" | 2.27" | 2.33" |
| SECT. 9 SOLE THICKNESS 20a | .50" | .50" | .50" | .53" | .56" | .59" | .62" | .65" | .68" | .71" | .77" |
| SECT. 9 BLADE HEIGHT | 1.55" | 1.57" | 1.59" | 1.61" | 1.62" | 1.64" | 1.66" | 1.75" | 1.77" | 1.79" | 1.83" |
| SECT. 10 SOLE THICKNESS | .47" | .48" | .49" | .50" | .71" | .52" | .53" | .54" | .55" | .56" | .58" |
| SECT. 10 BLADE HEIGHT | 1.135" | 1.140" | 1.145" | 1.150" | 1.155" | 1.160" | 1.165" | 1.220" | 1.225" | 1.230" | 1.240" |
| SOLE RADIUS FRONT TO BACK | — | — | — | — | — | 1¼"R | — | 2" | 2½" | 3" | 3½" |
| CLUB LENGTH | 39½" | 39" | 38½" | 38" | 37½" | 37" | 36½" | 36" | 35½" | 35½" | 35½" |
| FINISHED HEAD WEIGHT (GRAMS) | 224 | 230 | 237 | 244 | 251 | 258 | 265 | 272 | 279 | 283 | 287 |

While a preferred embodiment of a set of golf irons has been illustrated and described, it will be understood to those skilled in the art that changes and modifications may be made therein without departing from the invention in its broader aspects.

Various features of the invention are defined in the following claims.

What is claimed is:

1. A golf club head of the iron type comprising a body defining a substantially planar ball-striking face extending between a heel portion and a toe portion and having a lower marginal edge intersecting a lower sole surface, said face having a plurality of parallel grooves or score lines formed therein so that the grooves are disposed substantially horizontally when the club head is in a normal ball-addressing position, said body being of substantially uniform density metal throughout and having a back surface and a hosel enabling attachment of the club head to a shaft, said back surface having a generally convex envelope and having a single uninterrupted cavity formed therein configured so that a substantial portion of the weight of the head is distributed about the perimeter of the cavity and creates an optimum ball impact point centrally on the ball-striking face, said perimeter weight distribution creating a plurality of theoretical substantially elliptical force lines on said face concentric with said central impact point and with the major axis of said elliptical force lines parallel to said grooves.

2. A golf club head as defined in claim 1 wherein said head has an upper edge surface contiguous to an upper marginal edge of said ball-striking face, said upper edge surface having substantially parallel leading and trailing marginal edges and being inclined upwardly from said heel portion to said toe portion relative to said sole surface.

3. A golf club head as defined in claim 1 wherein said cavity is configured to create an integral weight mass in the upper toe region of the body sufficient to orient the major axis of said theoretical elliptical force lines to an orientation parallel to said grooves, said weight mass being confined within said convex envelope.

4. A golf club head as defined in claim 3 wherein said body is made of a solid metallic material.

5. A golf club head as defined in claim 3 wherein said cavity is defined in part by a lower boundary surface having an upward curvature adjacent said body toe portion, said weight mass being contiguous to said upward curvature of said lower boundary surface.

6. A golf club head as defined in claim 5 wherein said weight mass has a boundary surface blending with said upward curvature of said lower boundary surface of said cavity.

7. A golf club head as defined in claim 5 wherein said lower boundary surface of said cavity is inclined downwardly and intersects said sole surface intermediate its length along a line of intersection so as to create a concave recess in a trailing edge of said sole surface.

8. A golf club head as defined in claim 1 wherein each hosel is of substantially equal length in a set of golf irons progressing from an iron having a relatively small loft angle to an iron having a larger loft angle.

9. A golf club head as defined in claim 1 wherein said cavity has a substantially planar base surface, and wherein a recess is formed in said base surface.

10. A golf head as defined in claim 9 wherein said recess has a substantially elliptical peripheral configuration.

11. A golf club head of the iron type comprising a body defining a substantially planar ball-striking face extending between a heel portion and a toe portion and having a lower marginal edge intersecting a lower sole surface, said face having a plurality of parallel grooves or score lines formed therein so that the grooves are disposed substantially horizontally when the club head is in a normal ball-addressing position, said body further having a back surface and a hosel enabling attachment of the club head to a shaft, said back surface having a cavity formed therein of a configuration causing a substantial portion of the weight of the head to be distributed about the perimeter of the cavity and create an optimum ball impact point centrally on the ball-striking face, said perimeter weight distribution creating a plurality of theoretical substantially elliptical force lines on said face concentric to said central impact point and with the major axis of said elliptical force lines parallel to said grooves, the size of the cavity in the back surface of each iron in a set of irons, progressing from an iron of relatively small loft angle to an iron of larger loft angle, being progressively increased while maintaining the optimum ball impact point substantially centered on the ball-striking face.

12. A set of golf club irons of the perimeter weighted type including a range of irons from smaller loft angle irons to larger loft angle irons, each iron comprising a shaft and a head having a toe portion, a heel portion including a hosel for attachment to the shaft, a ball-striking face extending from the toe portion to the heel portion and having a plurality of parallel grooves formed therein which are disposed substantially horizontally when the head is in a ball addressing orientation, and a generally convex back surface envelope extending from an upper edge surface to a bottom sole surface, each of said heads consisting essentially of a uniform density metal and having a single uninterrupted cavity formed in its back surface configured so that the weight of the club head is selectively distributed about the perimeter of the head and establishes an integral weight mass in the upper toe portion of the head sufficient to create a plurality of theoretical elliptical force lines concentric with an optimum impact spot centered on the club face and having their major axis substantially parallel to the grooves on the face.

13. A set of golf irons as defined in claim 12 wherein said integral weight mass in the upper toe portion of the head is formed so as not to protrude outwardly from said convex back surface envelope.

14. A set of golf club irons as defined in claim 12 wherein the size of the cavity in the back surface of each iron, progressing from an iron of relatively small loft angle to an iron of larger loft angle, is progressively increased while maintaining the optimum ball impact substantially centered on the ball-striking face.

15. A golf iron of the perimeter weighted type comprising a shaft, a head having a hosel for connection to said shaft, said head consisting essentially of a substantially uniform density metallic material and having a ball-striking face extending between a toe portion and a heel portion and having a plurality of parallel grooves formed in said face which are disposed substantially horizontal when the head is in a ball-addressing orientation, a sole, and a back surface having a generally convex outer envelope, said back surface having a single uninterrupted cavity formed therein configured to establish a predetermined distribution of the weight of said head about the perimeter of the head with an integral weight mass in the upper toe portion within the convex outer envelope so as to create a centered optimum impact spot on said ball-striking face and a plurality of theoretical elliptical force lines on said ball-striking face concentric with said optimum impact spot with the major axis of the concentric elliptical force lines substantially parallel to said horizontal grooves in said ball-striking face.

16. A perimeter weighted golf iron as defined in claim 15 wherein said cavity and perimeter weighting cause any rotation of the head, due to striking a ball horizontally off-center from the sweet spot, to take place about a substantially vertical axis of rotation.

17. A golf club head as defined in claim 15 wherein said head has an upper edge surface contiguous to an upper marginal edge of said ball-striking face, said upper edge surface extending upwardly from said heel portion to said toe portion and having substantially parallel forward and rear marginal edges.

18. A golf club head as defined in claim 15 wherein said cavity is defined in part by a lower boundary surface having an upward curvature adjacent said body toe portion, said weight mass being contiguous to said upward curvature of said lower boundary surface.

19. A golf club head as defined in claim 18 wherein said weight mass has a boundary surface blending with said upward curvature of said lower boundary surface of said cavity.

20. A golf club head as defined in claim 15 wherein each hosel is of substantially equal length in a set of golf irons progressing from an iron having a relatively small loft angle to an iron having a larger loft angle.

* * * * *

UNITED STATES PATENT AND TRADEMARK OFFICE

CERTIFICATE OF CORRECTION

PATENT NO. : 5,333,872

DATED : August 2, 1994

INVENTOR(S) : Manning et al.

It is certified that error appears in the above-indentified patent and that said Letters Patent is hereby corrected as shown below:

In the Abstract, line 8, "no" should be --to--.

Column 10, line 18, after "impact" insert --point--.

Signed and Sealed this

Twenty-seventh Day of December, 1994

*Attest:*

BRUCE LEHMAN

*Attesting Officer*

*Commissioner of Patents and Trademarks*